US007358015B2

(12) United States Patent
Bellino et al.

(10) Patent No.: US 7,358,015 B2
(45) Date of Patent: Apr. 15, 2008

(54) PLASTICIZED PHOTOCONDUCTOR

(75) Inventors: Mark Thomas Bellino, Loveland, CO (US); Catherine Mailhé Randolph, Longmont, CO (US); Kasturi Rangan Srinivasan, Longmont, CO (US)

(73) Assignee: Lexmark International, Inc., Lexington, KY (US)

( * ) Notice: Subject to any disclaimer, the term of this patent is extended or adjusted under 35 U.S.C. 154(b) by 329 days.

(21) Appl. No.: 11/144,307

(22) Filed: Jun. 3, 2005

(65) Prior Publication Data

US 2006/0275681 A1 Dec. 7, 2006

(51) Int. Cl.
*G03G 15/02* (2006.01)

(52) U.S. Cl. ..... 430/58.4; 430/58.5; 430/58.8; 430/59.6

(58) Field of Classification Search ..... 430/58.4, 430/58.5, 58.8, 59.6
See application file for complete search history.

(56) References Cited

U.S. PATENT DOCUMENTS 6,099,998 A * 8/2000 Shibata et al. ..... 430/59.6
6,183,921 B1 2/2001 Yu et al.
6,205,307 B1 * 3/2001 Nukada et al. ..... 399/152
6,485,873 B1 11/2002 Ohkura et al.

FOREIGN PATENT DOCUMENTS

| | | |
|---|---|---|
| DE | 3148 840 A1 | 6/1983 |
| EP | 0 447 078 A2 | 9/1991 |
| JP | 60-225161 | 11/1985 |
| JP | 05-323633 | 12/1993 |

* cited by examiner

*Primary Examiner*—Mark A. Chapman
(74) *Attorney, Agent, or Firm*—Steven J. Grossman

(57) ABSTRACT

Plasticizers in a charge transfer layer to reduce surface cracking and crazing having a hydrocarbon chain, attached to a hindered phenol containing triazole or triazine moiety. Plasticizers found useful for this application can be used in a concentration (by weight of the charge transfer layer) in the order of magnitude of 10% to about 25%. The plasticizer additive may also be used in combination with other known plasticizers such as those containing a 2-ethylhexyl group.

20 Claims, No Drawings

PLASTICIZED PHOTOCONDUCTOR

TECHNICAL FIELD

This invention describes a method to improve the resistance of a photoconductor or a photoreceptor to cracking, crazing or crystallization, by the incorporation of UV absorbing plasticizers.

BACKGROUND OF THE INVENTION

An electrophotographic photoreceptor essentially comprises a charge generation layer (CGL) and charge transport layer (CTL) coated on a suitable substrate. The substrate may be an aluminized MYLAR polyester terephthalate or an anodized aluminum drum. An aluminum drum can be coated with a suitable sub-layer and/or a barrier layer, derived by dispersing metal oxides in a polymer binder.

The charge generation layer comprises pigments or dyes selected from phthalocyanines, squaraines, azo compounds, perylenes etc. The pigment or dye may be dispersed or dissolved in a suitable solvent, with or without a polymer binder.

The charge transport layer usually comprises a charge transport material or multiple charge transport materials in a polymer matrix. Additives such as silicone oils, silicone resins, fluoropolymers or inorganic oxides may also be used. An overcoat layer comprising only a polymer layer or a charge transport material-polymer composite may also be used.

An area of active interest is to increase the life of the photoconductor drum or member. As the photoconductor or photoreceptor life is increased significantly, it is possible to have the photoconductor as a part of a printer rather than as a component in a cartridge with toner which is periodically replaced. This helps lower the cost of the laser toner cartridge.

However, as the photoconductor becomes part of the printer, rather than the cartridge, the probability of the photoconductor coating being touched and the subsequent attack of the coating due to finger-based oils, can result in surface deterioration of the coating by cracking or crazing. The cracks or craze thus developed on the photoconductor coating can result in a print defect, resulting in a failure. Also, as the cracks develop on the point of contact, these cracks or crazing can propagate and result in the entire photoconductor coating being cracked or crazed. This invention is directed to improving the resistance of a photoconductor to cracking or crazing as caused by accidental touching of the photoconductor coating.

This invention will discuss the merits and de-merits of prior art, and outline the best mode of operation.

JP 60-225161 patent application (Sato et al., Sony Corp.), U.S. Pat. No. 6,183,921 B1(Yu et al., Xerox Corp) and JP 05-323633 patent application (Kawakami, Ricoh KK) discuss the use of plasticizers that are either dialkylterephthalates (Sony Corp.) or linear or branched esters that may be either aliphatic or aromatic based systems to prevent crack formation and be curl-resistant.

The foregoing JP 05-323633 discloses a photosensitive layer that contains a charge generating agent, a charge transporting agent, a dialkylterephthalate ($C_{1-8}$) hydrocarbon chain and a polycarbonate binder.

DE 314840 A1 discusses the use of ferrocene as a plasticizer to prevent cracking (Baumgartner et al., Standard Elektrik Lorenz AG).

EP 0 447 078 A2 patent application et al, Thomson Consumer Electronics, Inc. and RCE Licensing Corp. describes the use of an n-propylphthalate, dioctylphthalate or diundecylphthalate as a plasticizer in a photoconducting layer. The photoconductive layer comprises an organic polymer, a photoconductive dye, and a plasticizer.

The foregoing JP 05-323633 is to a single-layer photoreceptor. The foregoing U.S. Pat. No. 6,183,921 is based on polymeric charge transport material, and in particular polymeric tetraaryl-substituted biphenyldiamine. Also, U.S. Pat. No. 6,183,921 specifically discusses the benefit of using diethyl phthalate at 4% to about 8% concentration (by weight) in the charge transport layer. However the charge transport layer cracking studied was induced when the charge transport layer is in contact with a solvent. U.S. Pat. No. 6,189,921 does not discuss the cracking phenomenon in small molecule (non-polymeric) charge transport material based layers. Hence, it is not clear that the cracking is inherently related to the polymeric charge transport material.

The inventors also believe that a Japanese reference, specific details apparently lost, describes the use of an n-propylcarbazol as a plasticizer, to help prevent crack formation.

DISCLOSURE OF THE INVENTION

The present invention will show that a non-polymeric charge transport material is a significant contributor to stress cracking, and that a polycarbonate when coated on an aluminum drum or a curved surface is also prone to stress cracking. The invention will show that all plasticizers are not capable of preventing such surface deterioration, and those plasticizers that may help prevent such surface deterioration may have an effect on drum electrostatics, which in turn relates to prints appearing light. Further the invention will show that the minimum concentration of the plasticizer in the charge transport layer to significantly reduce surface deterioration is (by weight) generally about 8%, and preferably is generally about 10% to about 15%.

Plasticizers used for the application contain a branched or $C_6$ or longer carbon chain, attached to a hindered phenol containing triazole, triazine moiety or the like. Plasticizers found useful for this application can be used in a concentration (by weight of the charge transfer layer) of generally about 8% to about 25%, and more preferably generally about from 8% to about 20%. The plasticizer additive may also be used in combination with other known plasticizers such as those containing a branched hydrocarbon (for example containing 2-ethylhexyl group). The use of this plasticizer also helps the photoconductor from any deleterious effects due to ultra-violet light. In contrast to other plasticizers, benzotriazole based plasticizer does not affect the electrostatic or wear properties.

DESCRIPTION OF THE PREFERRED EMBODIMENTS

The addition of plasticizers in the rigid polymer lowers the glass transition temperature, thereby lowering the rigidity or increasing the flexibility of the polymer. In a similar manner, it was found that charge transport materials that are relatively rich in aryl moieties, increase the crystallinity characteristic of the material, and when used in a charge transport layer along with a polymer, tend to undergo stress cracking. The stress crack may be initiated by merely touching the surface of the coating, or in some cases when in contact with a solvent. It may also be mentioned that the polymers by themselves are inherently prone to stress cracking, when coated on curved surfaces, such as an aluminum drum.

In some charge transport layers, the charge transport material helps plasticize the polymer, and hence does not result in cracking or crazing behavior. These charge transport materials have fewer aryl groups, limiting the tendency of the material to crystallize and possibly craze. Charge transport materials which are less or not prone to crazing are N,N-diethylaminophenylbenzaldehyde -diphenylhydrazone (DEH), and tri-p-tolylamine (TTA). As will be shown later, in some cases, the polycarbonate used has an effect on stress cracking too. In the case of DEH, no cracking or crazing is observed, when the binder corresponds to a bisphenol-A polycarbonate (PCA). However, coatings that contain a DEH transport material in a polymer matrix where in at least 25% of the polycarbonate is a derivative of bisphenol-Z polycarbonate (PCZ), the coatings are prone to craze.

Test Method

Initial photoinduced discharge (PID) was measured by charging the drum using a charge roll, and measuring the discharge voltage as a function of laser energy, using a 780 nm laser. The PID was obtained as a plot of negative photoconductor voltage (−V) against laser energy (μJ/cm2) in an off-line parametric tester. In some cases, the drums were electrically cycled by repeated charge/discharge, for 1000 cycles, and the PID measured, followed by the measurement of the dark decay. Dark decay (V/see) (alternatively V/s) corresponds to the voltage lost as a function of time, without light present.

Positive fatigue corresponds to photoconductor drums that discharge at lower voltages on cycling (repeated charge/discharge cycles) the drums, i.e. if a drum discharges to −200V, and discharges to −150V on cycling, the drum is exhibiting positive fatigue of +50V. In this case, if the drum were to be used in printing a page, the prints corresponding to the lower discharging system would be darker than the initial prints.

Similarly, negative fatigue corresponds to a drum exhibiting a discharge voltage that is higher than the initial. For example, if a drum on exposure to room light discharges at −200V instead of its −150V initial discharge, the drum exhibits −50V (or a negative fatigue of 50V). Positive and negative fatigue terminology is also applicable to the change in dark decay for the drum on electrical cycling.

Evaluation of Crazing or Cracking

A finger-print was placed on the drum by touching the drum, and additionally hand lotion was also placed on the drum. The drum was then placed in an oven (at 60 C), and the resistance of the coating to cracking or crazing was monitored. In most cases, drums were placed in the oven for at least 2 weeks, and further monitored over several weeks. The photoconductor drums were then examined under an optical microscope (up to 1000× magnification), and further tested for failure by printing the same drums, and analyzing the print quality.

Benzotriazole Based UV Absorber

TINUVIN 384-2: (Ciba Specialty Chemicals Corp, 3-(2H-benzotriazol-2-yl)-5-(1,1-dimethylethyl)-4-hydroxybenzenepropanoic acid, $C_{7-9}$ branched alkyl esters), is a UV absorber that contains a $C_{7-9}$ branched alkyl ester. It has a minor component of propylene glycol methyl ether acetate. The following structural formula is that of the foregoing benzotriazole.

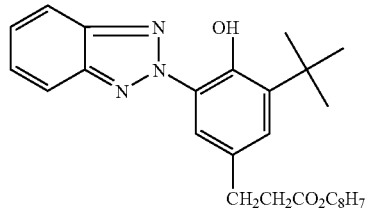

This material was used at about 11% (by weight) in a charge transport layer, containing TPD (N,N-bis(3-methylphenyl)-N,N'-bis-phenyl-benzidine), polycarbonate-Z (PCZ) (TPD/PCZ: 35/65 by weight), in a tetrahydrofuran (THF)/1,4-dioxane solvent: This plasticizer loading is in relation to the TPD and polycarbonate.

In the following Table 1 PCZ300 is polycarbonate-Z at having Mn of about 30,000 and PCZ400 is polycarbonate-Z having Mn of about 40,000. TPD is a well known charge transfer agent. PDMS is an abbreviation for polydimethyl siloxane, the commercial source being DC 200 from Dow Corning.

TABLE 1

| Material | Comp. Example 1 | Example 1 |
|---|---|---|
| TPD | 31.5 g | 31.5 g |
| PCZ300 | 43.9 g | 43.9 g |
| PCZ400 | 14.6 g | 14.6 g |
| THF | 263 g | 263 g |
| 1,4-Dioxane | 87 g | 87 g |
| Surfactant (PDMS, DC 200) | 0.6 g | 0.6 g |
| TINUVIN 384-2 | 0 g | 10.8 g |

Both the Comparative Example 1 and Example 1 drums were evaluated for electrostatics and evaluated for wear in a Lexmark C750 printer (20/20ppm, black/color, 20000 pages). The coating thickness was evaluated prior to life test in the printer and following the life test. In addition to the life test, the drums were evaluated for crazing behavior, using the finger-print and lotion tests. Drums that were evaluated over a cartridge life, were then tested again for the crazing phenomenon. Results are presented below. In the table 95/190PWN represents laser power, 95 being one-half laser power and 190 being nominal laser power.

TABLE 2

| ID | Start of life Discharge (95/190 PWM) | End of life Discharge (95/190 PWM) | Fatigue 95 PWM | Fatigue 190 PWM | Coating loss (μ/Kpages) |
|---|---|---|---|---|---|
| Comp Example 1 | −204 V/−62 V | −299 V/−80 V | −95 V | −18 V | 0.63 |
| Example 1 | −203 V/−70 V | −314 V/−94 V | −111 V | −24 V | 0.70 |

Comparative Example 1, failed the crazing test in less than 6 hours, whereas the TINUVIN 384-2 additive drum (Example 1) did not exhibit any signs of crazing even after 3 weeks. The crazing test was again repeated after the cartridge life test in a printer. The control drum failed and no sign of crazing was observed in the end-of-life TINUVIN 384-2 additive drum. Therefore, it may be concluded that the additive was not leached out of the coating during the life test in a printer. Also, the addition of the benzotriazole containing branched ester did not affect the print quality.

To further confirm if the additive was still present in the charge transport layer, drum coatings were visually observed under an optical microscope (500× magnification). In both start and end-of-life drums containing the TINUVIN 384-2 additive, the additive was seen as discreet droplets. Also, the coating of start and end-of-life drums were extracted in a tetrahydrofuran solvent, dried and re-dissolved in deuterated chloroform, and analyzed using Nuclear Magnetic Resonance. The ratio of TPD/PCZ/TINUVIN 384-2 at start of life and end of life were similar, suggesting no loss of the plasticizer during the printing process. Hence it appears that the use of TINUVIN 384-2 as an additive in the charge transport layer does not affect the electrostatic behavior, and improves the craze or crack resistance of the coating significantly.

It may also be borne in mind that the addition of plasticizers generally lower the glass-transition temperature, which in turn affects the mechanical properties. In this case, the Tg of the TINUVIN 384-2 additive containing transport layer was about 61 C, in comparison to 83 C for the Comparative Example 1. The lowering of the Tg, did not significantly affect the overall coating loss.

Comparison of TINUVIN 384-2 Additive vs Eastman 425 Plasticizer:

To further probe the effect of plasticizers Eastman 425, a commercially available plasticizer, was used. Eastman 425 contains a mixture of bis(2-ethylhexyl)terephthalate and diethyleneglycol dibenzoate in a 3/1 ratio. A formulation involving this additive is shown in Table 3 below.

TABLE 3

| Material | Comp. Example 2 | Example 2 | Example 3 |
|---|---|---|---|
| TPD | 31.5 g | 31.5 g | 31.5 g |
| PCZ400 | 58.5 g | 58.5 g | 58.5 g |
| THF | 263 g | 263 g | 263 g |
| 1,4-Dioxane | 87 g | 87 g | 87 g |
| Surfactant (PDMS, DC 200) | 0.6 g | 0.6 g | 0.6 g |
| Eastman 425 | 0 g | 10.8 g | 0 g |
| TINUVIN 384-2 | 0 g | 0 g | 15.3 g |

All drums from the above table were then evaluated in a printer, and results are shown below:

TABLE 4

| ID | Start of life Discharge (95/190 PWM) | Discharge at 10K prints (95/190 PWM) | Fatigue 95 PWM | Fatigue 190 PWM | Coating loss (μ/Kpages) |
|---|---|---|---|---|---|
| Comp Example 2 | −384 V/−253 V | −420 V/−250 V | −36 V | +3 V | 0.71 |
| Example 2 (TINUVIN 384-2) | −416 V/−302 V | −442 V/−307 V | −26 V | −5 V | 0.70 |
| Example 3 (Eastman 425) | −409 V/−288 V | −498 V/−375 V | −89 V | −87 V | 0.71 |

As seen in Table 4, addition of Eastman 425 has a significant impact on the initial electrostatics and end-of-life electrostatics, resulting in significant negative fatigue. On the other hand, TINUVIN 384-2 additive drum (Example 3) exhibited similar fatigue characteristics as the Control drum (Comp. Example 2). The significant negative fatigue seen in Example 2, results in print appearing light. It may be noted that addition of either plasticizer does not impact the drum wear properties. As seen earlier, all drums from the above table were evaluated for ratio of the TPD/PCZ300/additive for start and end of life drums. Ratios of TPD/PCZ300/additive were similar at start and end of life, indicating no loss of the additive due to leaching. In addition to the above, both Example 2 and Example 3 were subjected to a finger-print and lotion test, and no crazing or cracking was observed.

Other plasticizers commonly used in the polymer industry were also evaluated. Two such plasticizers are bis(2-ethylhexyl)sebacate (BEHS) and tri(ethyleneglycol)bis(2-ethylhexanoate) (TEGEH). Both materials were used at about 10% in the transport layer, and formulations corresponding to these are shown below:

TABLE 5

| Material | Comp. Example 3 | Example 4 | Example 5 |
|---|---|---|---|
| TPD | 31.5 g | 31.5 g | 31.5 g |
| PCA | 43.9 g | 43.9 g | 43.9 g |
| PCZ400 | 14.6 g | 14.6 g | 14.6 g |
| THF | 263 g | 263 g | 263 g |
| 1,4-Dioxane | 87 g | 87 g | 87 g |
| Surfactant(PDMS, DC 200) | 0.6 g | 0.6 g | 0.6 g |
| Bis(2-ethylhexyl)sebacate | 0 g | 9 g | 0 g |
| Tri(ethyleneglycol)-bis(2-ethylhexanoate) | 0 g | 0 g | 9 g |

Drums containing the above formulations were evaluated in a Lexmark C750 printer, to about 5000 pages, and results are presented below.

TABLE 6

| ID | Start of life Discharge (95/190 PWM) | Discharge at 10K prints (95/190 PWM) | Fatigue 95 PWM | Fatigue 190 PWM |
|---|---|---|---|---|
| Comp Example 3 | −192 V/−68 V | −181 V/−72 V | −11 V | −4 V |
| Example 4 | −198 V/−80 V | −274 V/−172 V | −76 V | −92 V |
| Example 5 | −222 V/−85 V | −354 V/−263 V | −132 V | −178 V |

As seen in Table 6, both additives that mitigate crazing phenomenon have a deleterious effect on the electrostatics fatigue through 5000 prints, leading to severe print lightening. Hence it is obvious from the above examples that although most plasticizers can help mitigate or eliminate cracking or crazing due to finger-print or lotion, its critical to evaluate the effect of the plasticizer on the electrophotographic properties also. In a similar manner other plasticizers were also screened for their effectiveness in mitigating/eliminating crazing/cracking and also for their influence on the electrophotographic properties. The following table (Table 7) summarizes results for these systems:

TABLE 7

Evaluation of several plasticizers for discharge voltage, discharge fatigue and crazing (electrostatics as measured on an off-line parametric tester, with settings similar to a printer).

| Plasticizer | V(0.32 uJ) | V(1 uJ) | Fatigue (0.32 uJ) | Fatigue (1 uJ) | Crazing |
|---|---|---|---|---|---|
| Control (0% plasticizer) | −110 V | −86 V | 7 V | 6 V | Yes |
| 10% TXIB (2,2,4-trimethyl-1,3-pentanediol diisobutyrate) | −101 V | −81 V | −30 V | −32 V | No |
| 10% Diisooctyl dodecanedioate | −94 V | −58 V | −20 V | −21 V | No |
| 10% Plasticizer 97 (adipic acid dialkyl (C7-9)ester) | −85 V | −56 V | −15 V | −16 V | No |
| 2% BriJ-76 (Polyethyleneglycol-octadecylether) | −143 V | −123 V | −43 V | −45 V | Yes |
| 2% Polyethyleneglycol-bis(2-ethylhexanoate) | −73 V | −57 V | −7 V | −4 V | Yes |
| 5% Polyethyleneglycol-bis(2-ethylhexanoate) | −92 V | −70 V | −17 V | −16 V | Yes |
| 10% Polyethyleneglycol-bis(2-ethylhexanoate) | −105 V | −83 V | −72 V | −71 V | No |
| 5% isooctyl Tallate | −113 V | −66 V | −6 V | −13 V | Yes |
| 10% Isooctyl Tallate* | −115 V | −114 V | −99 V | −70 V | |
| 12% Diisodecyl adipate | −142 V | −92 V | −30 V | −24 V | No |
| 12% Diisononyl phthalate | −130 V | −100 V | −12 V | −8 V | No |

*Isooctyl tallate recrystallized on drum

Several plasticizers were evaluated (concentrations based on TPD and polycarbonate), and as seen in Table 7, most plasticizers at higher loadings (>5% by weight) result in increasing the electrostatic cycling fatigue of the photoconductor drum. One such example is polyethyleneglycol-bis (2-ethylhexanoate) (PEG-EH), which exhibits a tendency to mostly increase negative fatigue with increase in concentration. Only at higher concentrations (~10%) does the material tend to mitigate the crazing behavior.

As is apparent from various examples described above, it is critical to control the electrostatic fatigue along with the tendency to craze. One approach is to use a blend of plasticizers. In Table 1, the use of the TINUVIN 384-2 additive was shown to mitigate/eliminate crazing, without affecting the electrostatic fatigue. As the addition of plasticizers (discussed with respect to Table 7) have an impact on electrostatics and cycling fatigue, it is possible to blend these plasticizers with an additive such as TINUVIN 384-2. Table 8 describes results from a blend experiment involving TINUVIN 384-2 additive and a second plasticizer. As the plasticizer concentration is lowered, by substituting TINUVIN 384-2 additive, the electrostatics (initial and electrical cycling fatigue) are similar to the control, with better resistance to crazing. In Table 8 concentration of plasticizer is by weight in relation to the TPD and the polycarbonate combined weights.

TABLE 8

Electrostatics and Crazing behavior for TINUVIN 384-2/Plasticizer blends

| Plasticizer | V(0.32 uJ) | V(1 uJ) | Fatigue (0.32 uJ) | Fatigue (1 uJ) | Crazing |
|---|---|---|---|---|---|
| Control (0% plasticizer) | −77 V | −44 V | 7 V | 6 V | Yes |
| 12% TINUVIN 384-2 | −105 V | −50 V | 3 V | −2 V | No |
| 6% TINUVIN 384-2/6% Diisoctyl phthalate | −106 V | −54 V | 2 V | −8 V | No |
| 9% TINUVIN 384-2/3% Diisoctyl phthalate | −110 V | −85 V | −9 V | −5 V | No |
| 3% TINUVIN 384-2/9% Diisoctyl phthalate | −109 V | −58 V | −1 V | −1 V | No |
| 6% TINUVIN 384-2/6% Diisononyl phthalate | −129 V | −87 V | −5 V | −6 V | No |
| 6% TINUVIN 384-2/6% Diisodecyl adipate | −124 V | −77 V | −5 V | −7 V | No |
| 5% Diisoctyl dodecanedioate/5% TINUVIN 384-2 384-2 | −94 V | −66 V | −2 V | 5 V | No |
| 7% Diisoctyl dodecanedioate/3% TINUVIN 384-2 384-2 | −113 V | −74 V | −22 V | −30 V | No |

In a similar manner, the use of these plasticizers or their blends can be used with other charge transport materials that are also prone to cracking/crazing. One such example is an N,N-(p-ditolyl)-4-aminophenylbenzaldehyde-diphenyl hydrazone (pTPH). The following Tables 9 and 10 describe the formulation and the effect of a plasticizer (TINUVIN 384-2) on the electrostatics and crazing behavior in a charge transport layer that comprises of 25% pTPH and 75% polycarbonate-A.

TABLE 9

Formulations

| Material | Comp. Example 4 | Example 6 |
|---|---|---|
| pTPH | 21 g | 21 g |
| PCZ300 | 49 g | 49 g |
| THF | 300 g | 300 g |
| 1,4-Dioxane | 30 g | 30 g |
| Surfactant (PDMS, DC 200) | 0.6 g | 0.6 g |
| TINUVIN-384-2 | 0 g | 9.8 g |

TABLE 10

Electrostatics as measured on an off-line parametric tester

| Plasticizer | V0.32 uJ | V1 uJ | Fatigue (0.32 uJ) | Fatigue (1 uJ) | Crazing |
|---|---|---|---|---|---|
| Control (0% plasticizer) | −156 V | −152 V | −2 V | 0 V | Yes |
| 14% TINUVIN 384-2 | −153 V | −148 V | −4 V | −5 V | No |

Another benzotriazole material that helps mitigate cracking of a photoconductor is 2,2'-methylenebis[6-(2H-benzotriazol-2-yl)-4-(1,1,3,3-tetramethylbutyl)phenol]. Structure of TMBP-B is shown below:

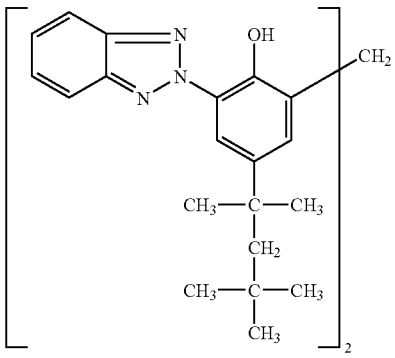

(TMBP-B)

Formulating this material at a 10% concentration in a TPD based transport (35% TPD/PCZ300) matrix, results in electrostatics similar to a control drum (0% TMBP-B), and does not exhibit any cracking due to contact with a finger print or a lotion. The following table (Table 11) illustrates the electrostatics and cracking behavior. Electrostatics correspond to an expose-to-develop time of 110 ms.

TABLE 11

Electrostatics of TMBP-B additive in TPD/PCZ transport (expose-to-develop: 110 ms)

| Transport layer | V0.18 uJ | V0.32 uJ | V1 uJ | Cracking |
|---|---|---|---|---|
| Control (35% TPD/PCZ300/0% plasticizer) | −231 V | −80 V | −61 V | Yes |
| Plasticizer (35% TPD/PCZ300/10% TMBP-B) | −229 V | −74 V | −48 V | No |

In a similar manner, the use of a hindered phenol triazine that contains a branched alkyl chain was also evaluated for crack resistance. Two UV absorber triazines were evaluated namely, TINUVIN 411L (contains isomeric iso-octyl groups), and TINUVIN 400 (contains a dodecyl alkyl group) in a 35% TPD and a mixture of polycarbonate-A (Mn~34 K) and polycarbonate-Z (Mn~30 K). Electrostatics (expose to develop time: 110 ms) and cracking behavior are shown in the following table:

TABLE 12

Electrostatics and Crazing behavior in a TINUVIN 400 or TINUVIN 411L system.

| Transport layer | V0.18 uJ | V0.32 uJ | V1 uJ | Cracking |
|---|---|---|---|---|
| 35% TPD/PC-A/Z/0% TINUVIN 400 | −174 V | −74 V | −44 V | Yes |
| 35% TPD/PC-A/Z/10% TINUVIN 400 | −218 V | −114 V | −83 V | No |
| 35% TPD/PCZ300/0% TINUVIN 411L | −259 V | −80 V | −53 V | Yes |
| 35% TPD/PCZ300/10% TINUVIN 411L | −264 V | −116 V | −76 V | No |

Where as the control drums (0% additive) failed for cracking/crazing, drums containing either TINUVIN 400 or TINUVIN 411L helped the cracking/crazing resistance. These drums were resistant to cracking/crazing over extended periods of time. This persuades that hindered phenol having a heterocyclic trinitrogen group with at least two nitrogen-to-carbon double bonds (unsaturation) and having a branched carbon chain or a carbon chain of $C_6$ or longer is functional in accordance with this invention.

Hence it is apparent that by the addition of such a plasticizer to a charge transport layer prone to cracking/crazing, cracking/crazing is mitigated or eliminated.

What is claimed is:

1. An electrophotographic photoconductor comprising a charge generation layer, a charge transport layer, said charge transport layer comprising a charge transport material, a polymer binder and a hindered phenol plasticizer having a heterocyclic trinitrogen group with at least two nitrogen-to-carbon double bonds and having a branched carbon chain substituent or a carbon chain substituent of $C_6$ or longer.

2. The photoconductor as in claim 1 in which said plasticizer is a branched alkyl ester attached to a benzotriazole moiety.

3. The photoconductor as in claim 2 in which said plasticizer is in amount by weight of less than about 20 percent by weight of the weight of said charge transfer layer.

4. The photoconductor as in claim 2 also comprising a plasticizer having a 2-ethylhexyl groups blended with said benzotriazole.

5. The photoconductor as in claim 3 also comprising a plasticizer having a 2-ethylhexyl groups blended with said benzotriazole.

6. The photoconductor as in claim 5 in which said blend is about 10 percent by weight of the weight of said charge transport layer.

7. The photoconductor as in claim 1 also comprising a plasticizer having a 2-ethylhexyl groups blended with said benzotriazole.

8. The photoconductor as in claim 1 in which said plasticizer is represented by the following structural formula:

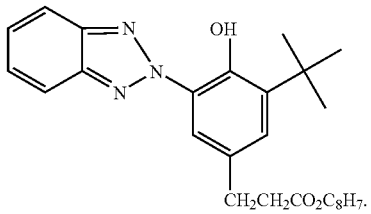

9. The photoconductor as in claim 1 in which said plasticizer is represented by the following structural formula:

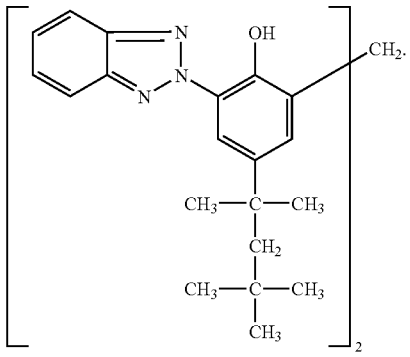

10. The photoconductor as in claim 1, wherein said plasticizer is present as discrete droplets in said charge transport layer.

11. An electrophotographic photoconductor comprising a charge generation layer, a charge transport layer, said charge transport layer comprising an arylamine or hydrazone charge transport material, a polymer binder and a hindered phenol plasticizer having a heterocyclic trinitrogen group with at least two nitrogen-to-carbon double bonds and having a branched carbon chain substituent or a carbon chain substituent of $C_6$ or longer.

12. The photoconductor as in claim 11 in which said charge transport material is N,N-bis-(3-methylphenyl)-N,N-bis-phenyl-benzidine.

13. The photoconductor as in claim 12 in which said plasticizer is a branched alkyl ester attached to a benzotriazole moiety.

14. The photoconductor as in claim 11 in which said charge transport material is a hydrazone.

15. The photoconductor as in claim 14 in which said plasticizer is a branched alkyl ester attached to a benzotriazole moiety.

16. The photoconductor as in claim 14 in which said hydrazone is DEH and said charge transport binder comprises polycarbonate and at least 25 percent by weight of said polycarbonate is polycarbonate-Z.

17. The photoconductor as in claim 11 in which said plasticizer is a branched alkyl ester attached to a benzotriazole moiety.

18. The photoconductor as in claim 11 in which said plasticizer is represented by the following structural formula:

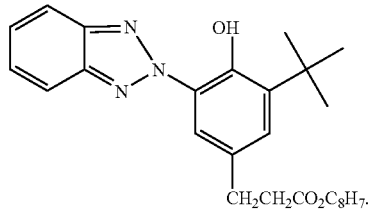

19. The photoconductor as in claim 11 in which said plasticizer is represented by the following structural formula:

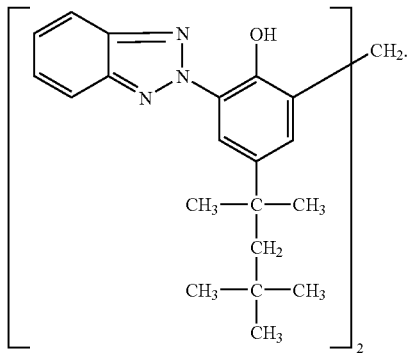

20. The photoconductor as in claim 11, wherein said plasticizer is present as discrete droplets in said charge transport layer.

* * * * *